United States Patent [19]

Kinsley

[11] 4,364,484

[45] Dec. 21, 1982

[54] CHILD RESISTANT CLOSURE

[75] Inventor: John P. Kinsley, Crystal Lake, Ill.

[73] Assignee: Seaquist Valve Company, division of Pittway Corporation, Cary, Ill.

[21] Appl. No.: 288,148

[22] Filed: Jul. 29, 1981

[51] Int. Cl.[3] ..... B65D 55/02; B65D 85/56; A61J 1/00

[52] U.S. Cl. ..... 215/220

[58] Field of Search ..... 215/219, 220, 221, 274

[56] References Cited

U.S. PATENT DOCUMENTS

| | | | |
|---|---|---|---|
| 3,669,294 | 6/1972 | Petronelli et al. | 215/220 |
| 3,756,444 | 9/1973 | McIntosh | 215/220 |
| 3,853,236 | 12/1974 | Ostrowsky | 215/220 |
| 3,977,554 | 8/1976 | Costa | 215/220 |

*Primary Examiner*—George T. Hall

*Attorney, Agent, or Firm*—Dressler, Goldsmith, Shore, Sutker & Milnamow, Ltd.

[57] ABSTRACT

An improved two-piece child resistant closure formed from an integrally molded assembly. An integrally molded closure portion connected to a collar portion by a frangible web, is adapted to be forced into an open-topped collar portion. The collar portion defines a recess to receive a closure clutch ring having a greater diameter than the recess defining portions of the collar portion, thereby to retain the closure and collar portions in assembled relationship. The clutch ring defines teeth on its upper surface and the collar portions defines complementary downwardly forcing teeth. The leading edges of the teeth which cooperate in the screw-on mode are generally vertical, and the trailing edges of the teeth which cooperate in the screw-off mode are inclined at a substantial angle to the vertical, whereby unless substantial downward force is exerted in the screw-off mode, the collar teeth are cammed upwardly by the closure teeth to defeat unscrewing of the closure.

14 Claims, 9 Drawing Figures

FIG. 5
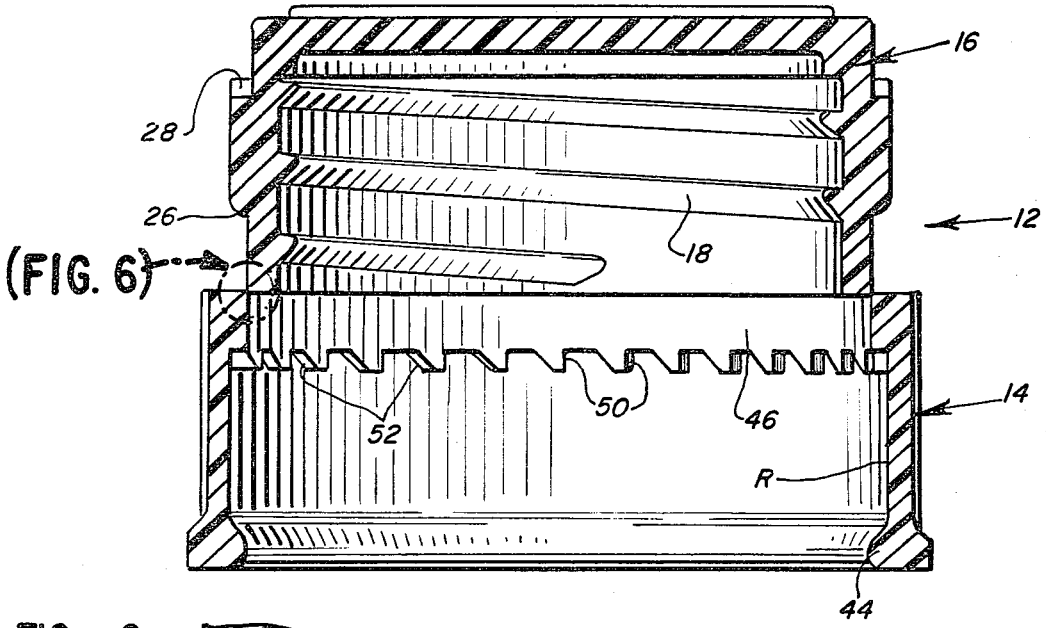
FIG. 6
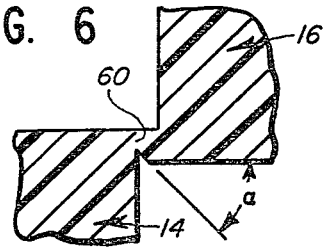
FIG. 8
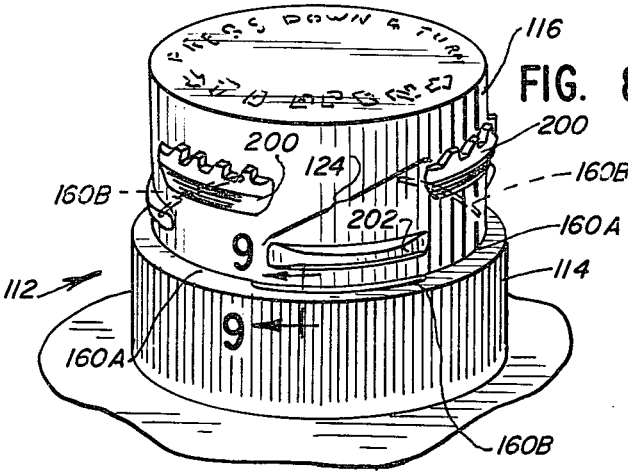
FIG. 9
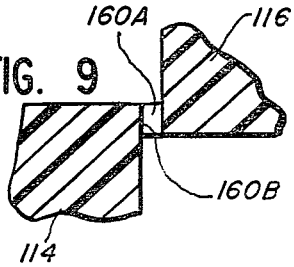
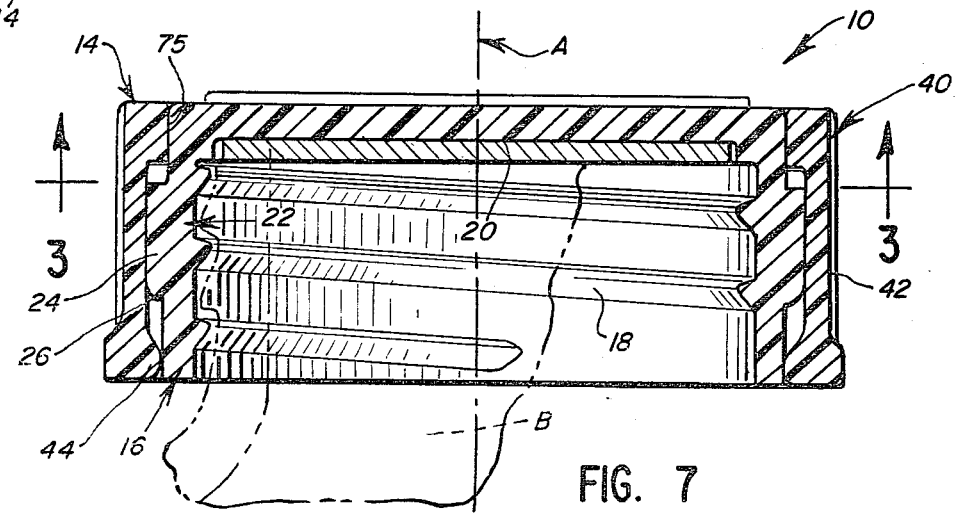
FIG. 7

CHILD RESISTANT CLOSURE

TECHNICAL FIELD OF THE INVENTION

This invention relates to improved child resistant closures for containers and bottles.

BACKGROUND OF THE INVENTION

A wide variety of child resistant closures have been suggested and a number are currently available on the market. All of those which are marketed in the United States, to be sold as child-resistant, must meet certain minimum standards of difficulty of opening by small children. Of course, it is also desirable that they be readily openable by an adult, and without the necessity of complicated instructions or the like.

Many such closures are of the two-piece, push-down type. That is to say that a first part serves as the closure for the bottle or container and a second part surrounding or overlying the closure is adapted to engage with the closure to effect both closing of the container by the closure and opening, by counterclockwise rotation of the closure. In all of these there is a clutching mechanism which facilitates interengagement of the closure and the second surrounding part to induce rotation of the closure.

Many such closure assemblies incorporate a spring-like or vertically deformable construction which maintains the second part in an up-position which, when pushed down, causes engagement of the clutch parts to permit opening and closing of the container. Typical of such devices are those illustrated by U.S. Pat. Nos. 3,692,199, 4,069,935, 2,964,207, 3,638,819 and 3,812,990.

Other of such closure assemblies rely upon inclined surfaces which interengage both in the screw-off mode, and U.S. Pat. Nos. 3,924,770, 3,946,890 and 4,241,840 typify such devices. All of those devices utilize second parts which cover the top of the closure.

Another device currently in use utilizes a second part which is a topless collar, and functions by lifting the collar upwardly to facilitate removal of the closure, and such a device is illustrated by U.S. Pat. No. 3,669,294.

Yet other devices utilize a squeeze-type of interaction between an overlying cap and a closure to permit unscrewing of the closure, and U.S. Pat. No. 3,809,274 typifies such a device.

All of these devices are made of at least two parts, frequently of diverse materials, which then require subsequent assembly. These devices, when assembled from multiple parts, require matching of parts to fulfill their childproof function.

SUMMARY OF THE INVENTION

The child-resistant closure assembly of this invention is adapted to be formed from a single molded part which is assembled into a two piece closure assembly by the expedient of severing a connecting web as one portion of the molded part is pushed down onto or into a second portion. The assembled closure thus has portions which properly match, eliminating problems encountered with tolerance mis-matching when multiple cavity molds for each of the two portions produce parts which, when assembled, may not match as closely as desired or necessary.

A child resistant closure assembly for the threaded neck of a container in accordance with this invention desirably comprises an internally threaded closure defining a thread complementary to the thread of a container neck and an internal upper sealing surface. The closure defines a sidewall bearing a radially outwardly extending clutch ring positioned generally medially of the height of the sidewall. The clutch ring defines a multiplicity of upwardly facing closure teeth equidistantly spaced about the periphery of the clutch ring, each tooth providing a generally vertical leading edge and an inclined trailing edge.

The assembly further comprises an open topped collar of about the same height as the closure, and provides an outer gripping surface and an inner recess for receiving the clutch ring. The recess is defined by a lower inwardly projecing retention bead and an upper collar clutch portion. The lower surface of the clutch portion defines a multiplicity of downwardly facing collar teeth equal in number to the closure teeth. Each collar tooth defines a generally vertical leading edge and an angled trailing edge.

The collar is preferably movable vertically upwardly with respect to said closure by no more than about twice the distance between the confronting surfaces of the clutch ring and the retention bead. Preferably, the inclined angled edges are inclined at different angles to the vertical. When the collar is rotated in a clockwise direction the vertical leading edges of the teeth engage, and when the collar is rotated in a counterclockwise direction, the trailing edges engage and the collar tooth angled trailing edge rides up the closure tooth inclined trailing edge, except when a downward force is exerted against the collar to maintain the trailing edges in engagement.

The nature of the structural arrangement is such that the force to maintain engagement upon unscrewing may be effectively and easily reduced to the minimum required to maintain the child-resistant characteristic of the closure assembly.

To form and assemble a closure assembly of this invention, desirably the collar and closure are integrally molded of plastic, and are connected by web means, such as a continuous web. The closure is proportioned to be forced into the collar, as by using a plunger which acts against the collar first to sever the connecting web, and then preferably in the press to thrust and force the closure into the collar in the assembled arrangement just described.

BRIEF DESCRIPTION OF THE DRAWINGS

Further objects, features and advantages of this invention will become apparent from the following specification and drawings which illustrate a presently preferred embodiment of the child-resistant closure of this invention.

FIG. 5 is a diametric cross-sectional view of the assembly of FIG. 1;

FIG. 6 is an enlarged fragmentary view of a portion of FIG. 5;

FIG. 7 is a cross-sectional view taken substantially along line 7—7 of FIG. 2;

FIG. 8 is a view similar to that of FIG. 1 of a further embodiment of this invention; and FIG. 9 is a view like that of FIG. 6, but is an enlarged view taken along line 9—9 of FIG. 8.

DETAILED DESCRIPTION

Figure 1:
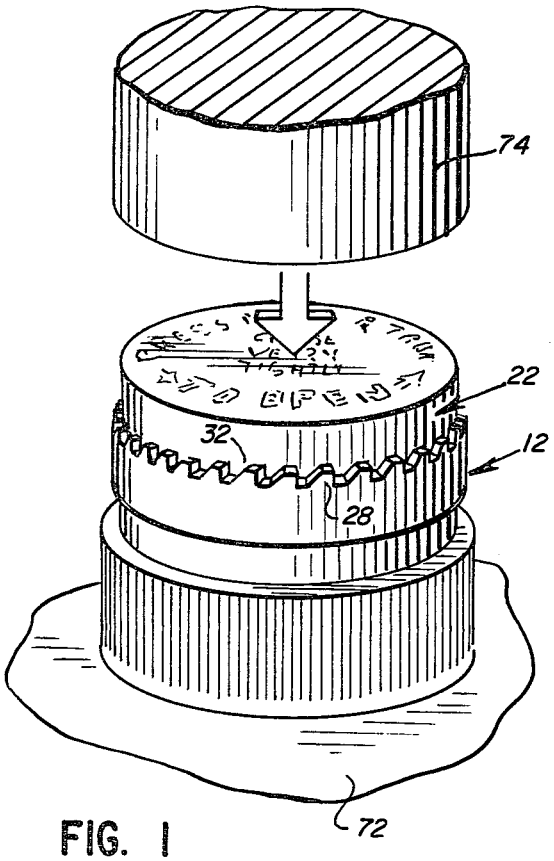
FIG. 1 is a perspective view of a molded assembly from which a child resistant closure assembly of this invention is adapted to be formed.
Figure 2:
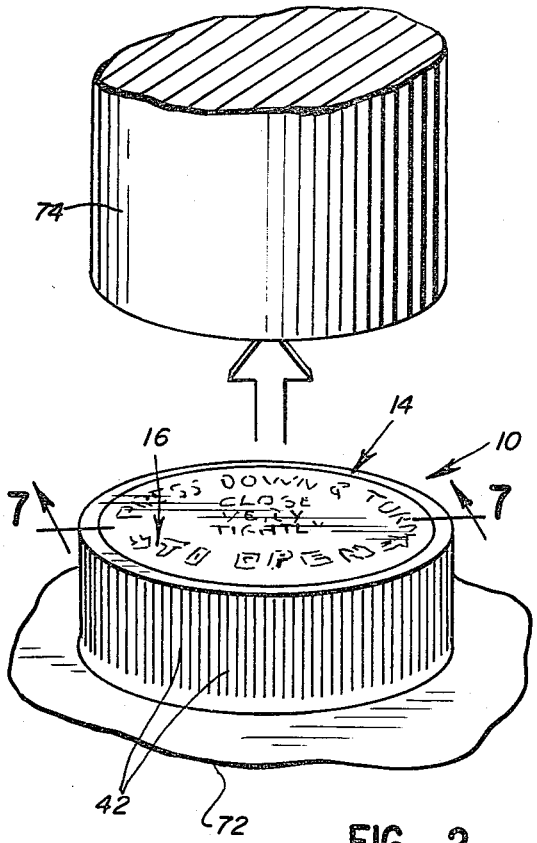
FIG. 2 is a perspective view of the closure assembly formed from the molded assembly of FIG. 1.
Figure 3:
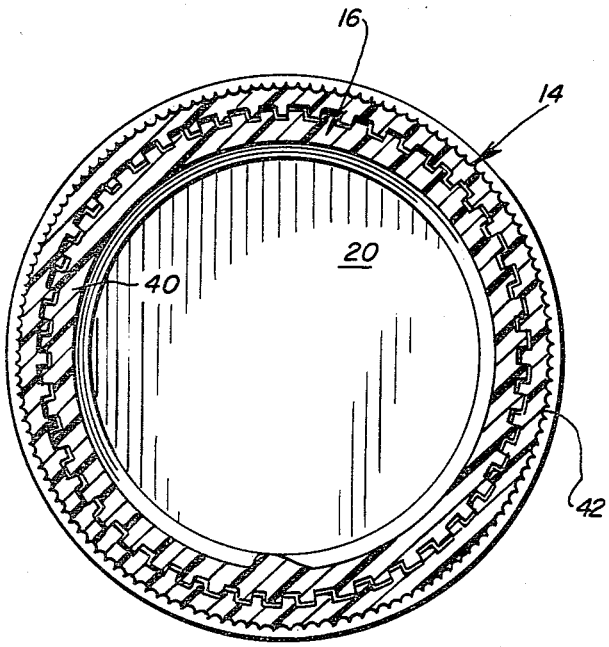
FIG. 3 is a sectional view of the closure assembly of FIG. 2 taken substantially along the line 3—3 of FIG. 7.

Referring now to the drawings, a two piece child resistant closure assembly 10 is adapted to be formed from a premolded assembly 12, preferably of a plastic material such as polypropylene. The closure assembly comprises a rotatable open-topped collar 14 and an internally threaded closure 16. The collar and closure 14 and 16 are proportioned so that the collar will freely rotate in both clockwise and counterclockwise directions on the closure and will be retained against axial removal from the closure, all as will be described.

The internally threaded closure 16 provides a continuous thread 18 proportioned to match and mate with the thread on the neck of a container or bottle B. The inner upper sealing surface 20 is proportioned to sealingly engage the lip of the bottle. A conventional closure insert or molded sealing surface (not shown) may be provided to form the seal with the lip of the bottle, thereby to provide a seal between the inner upper sealing surface of the closure and the associated bottle. The closure further comprises a side wall 22 which bears the closure thread on its interior surface and which provides a clutch ring 24 on its outer surface. The clutch ring extends radially outwardly of the sidewall 22 and is positioned intermediate the height of the sidewall 22 and preferably approximately medially of the height of the sidewall 22. The lower edge 26 of the clutch ring is radiused to aid assembly. The upper edge defines a multiplicity of upwardly facing closure teeth 28. Closure teeth 28 are equidistantly spaced about the periphery of the closure 16, and with a collar diameter of approximately 24 millimeters, comprise about thirty-six such teeth.

Figure 4:
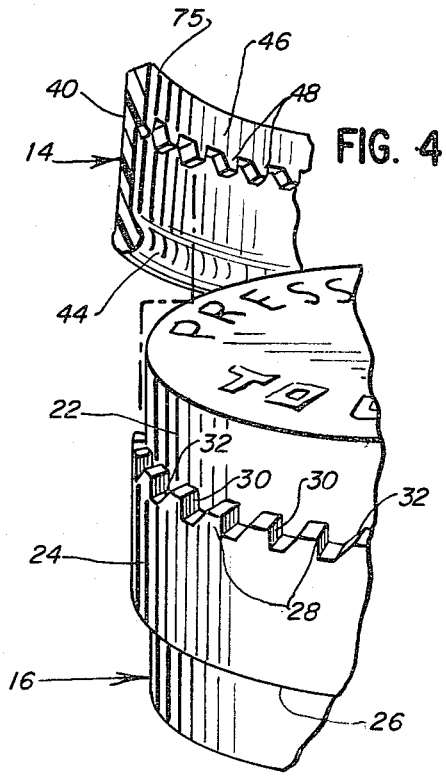
FIG. 4 is an exploded fragmentary perspective view of the assembly of FIG. 2.

The closure teeth are proportioned and adapted to facilitate both securance and loosening of the closure on the associated bottle B. To that end, each closure tooth comprises a leading edge 30 which is vertical and which is generally parallel to the axis A of the closure. However, the trailing edges 32 of the teeth are at a substantial incline, as may best be seen in FIGS. 1 and 4. The angles of incline and their purposes will be described later.

The collar 14 is open topped and is generally tubular in configuration and is approximately the same height as the closure. Collar 14 defines a generally cylindrical outer surface 40 which is preferably provided with vertical knurling 42 to facilitate gripping of the collar. At the lower reaches of the inner surface of the collar 14 an inwardly projecting retention bead 44 is provided. Bead 44 limits upward movement of the collar when it engages the lower edge 26 of the clutch ring 24. The upper reaches of the inner surface of the collar 14 provides an inwardly projecting clutch portion 46. The lower surface of the clutch portion 46 defines a multiplicty of clutch teeth 48 which are preferably equal in number to the closure teeth 28, although the numbers of teeth need not necessarily be the same. Each clutch tooth 48 comprises a generally vertical leading edge 50 which is generally parallel to the closure axis A and an angled trailing edge 52. Edges 50 and 52 are proportioned and adapted to cooperate with edges 30 and 32 of teeth 28 in a manner to be described.

It will be observed that the clutch portion 46 is at the top of the collar 14 and that the clutch teeth 48 are located well above the vertical center of the collar. Further, the vertical height of the teeth 28, 48, as best illustrated by FIG. 7, is preferably no more than about twice the distance between the confronting surfaces of upper surface of retention bead 44 and the lower edge 26 of the sidewall 22. Thus, when the collar is moved upwardly, in a manner to be explained, little additional movement is permitted, thereby limiting the tendency of the collar to cock on the closure, limiting possible jamming. Further, the confronting surfaces of the clutch ring 24 and the inner wall of the collar serve to guide the collar as it moves vertically with respect to the closure. It is also to be observed that the retention bead, collar clutch portion and collar wall define a recess receiving the clutch ring 24. As such, vertical movement of the collar is limited downwardly by the teeth of the clutch portion engaging those of the clutch ring and is limited upwardly by engagement between the retention bead and the lower edge 26 of the clutch ring.

When the closure assembly is to be secured to a bottle, the closure is positioned on the threaded neck of the bottle and is turned in a clockwise direction, utilizing the minimum down force consistent with child-resistant characteristics. The leading edges 30 and 50 of the teeth 28 and 48 engage. Because they are generally vertical there is no slippage, and the leading edges of the collar teeth act against the leading edges of the closure teeth to tighten the closure on the bottle. Of course slight angles from the vertical will not meaningful impair the operation of the closure in the screw-on mode, and rearward inclines, such as the type disclosed in U.S. Pat. No. 3,946,890 will also permit the closure assembly to screw on as if the body edges were substantially vertical, and such angular relationships for the leading edges are embraced within the meaning of the term generally vertical leading edges. In the screw-on mode the teeth are interdigitated at a relative vertical elevation substantially as illustrated in FIG. 7.

When, however, the closure is to be removed from the bottle B, additional procedures must be followed, procedures which are not readily perceived and followed by young children.

As mentioned, the trailing edges of the teeth are substantially inclined and angled, preferably at different and substantial angles from the vertical. Desirably the incline of the trailing edge 32 is about 30 degrees from the vertical and the angle of the trailing edge 52 is about 45 degrees from the vertical, and different from each other. Preferably there is always a difference of at least about five degrees. Preferably the angle of incline from the vertical is minimally about thirty degrees for the trailing edges of each of the teeth 28, 48. As such, when the inclined and angled edges are brought into engagement, the trailing edge 52 tends to ride up the incline of the trailing edge 32, thereby lifting the collar and preventing unscrewing of the closure. The differences in the angles of the confronting trailing faces enhance this effect by providing only point contact, rather than full face contact, between the faces of the confronting trailing edges. Thus, as the collar is rotated its tendency is simply to ride up and be cammed over the closure teeth, maintaining the closed, sealed relationship between the closure and the bottle.

To remove the closure 16 from the bottle it is therefore necessary to apply a vertically downward force against the collar, thereby to defeat the child-proof function provided by the inclined trailing edges of the interdigitated teeth 28, 48. To that end, when the collar is forced down against the teeth 28, the angled trailing edge 52 remains in contact with the inclined trailing edge 32, and as the collar is turned in a counterclockwise direction, the teeth remain in engagement, the closure is loosened and unscrewed, and access to the contents of the bottle becomes available.

It has been found by testing that the closure assembly of the invention is very easy for adults to understand and use, but very difficult for small children to operate to open. It has also been determined that re-securance of the closure assembly with a minimum downward force provides a renewed safety resistance which is as sound and effective as the original assembly, unlike many child-resistant closure assemblies presently available on the market.

The two-piece closure assembly 10 is desirably formed from a premolded unitary assembly 12. Although two-piece caps have been made from unitarily molded parts previously, for example, as described in U.S. Pat. No. 4,007,857, the formation of an assembly of the type here claimed has not previously been suggested as far as applicant understands it. The formation of a child-resistant closure from a unitarily molded assembly has substantial advantages in parts-matching from molds. Under normal conditions multi-cavity molds are used to make each of the several parts of a closure assembly. When that practice is followed, the parts from each of the cavities for one part must match and mate with parts from each of the cavities for the other part. Where tolerances are permitted, sometimes extremes in the pairs of parts will provide an assembly which will be less effective than the intended design. By providing a single cavity in which both of the parts of the assembly are formed together, later to be assembled together, tolerance variation effects are eliminated. Of course, other advantages in such a structure inhere as well. For example, assembly time and expense and handling is minimized and tooling and molding costs and expenses are minimized as well.

The two piece closure assembly 10, as stated, is formed from the premolded assembly 12. Assembly 12 comprises a collar 14 and a closure 16, joined and connected by a frangible connector web means such as a continuous web 60 (see FIGS. 5 and 6.) The clutch ring 28 is spaced vertically away from the recess R in the collar which is adapted to receive it. Web 60 may be continuous or may be discontinuous. Web 60 may also provide communication in the associated mold (not shown) for plastic flow between the closure and collar as the assembly 12 is molded.

When the assembly 12 is to be transformed into the closure assembly 10, the collar portion 14 is appropriately supported on a support 72 which may include an upstanding portion internally of the closure or a support sleeve externally of the closure (not shown) and the closure is forced downwardly, as by a suitable plunger 74. The web 60 is severed, edge 26 is forced downwardly against the upper, inner edge 75 of the collar (which may be of about the same diameter as that of the clutch ring) until the clutch ring reaches the position illustated in FIG. 7, i.e., until the clutch ring snaps into the collar recess R which then, by the collar clutch and retention bead, retains the clutch ring in the recess, thereby to maintain the collar and closure in assembled relationship.

Referring now to the embodiment of FIGS. 8 and 9, a two-piece closure assembly, like assembly 10, is adapted to be formed from a premolded assembly 112 formed as from polypropylene. The closure comprises a colar portion 110 and an internally threaded closure portion 116, proportioned, when assembled, to function like closure assembly 10.

In the embodiment of FIG. 8 clutch ring 124 is segmental and may comprise a series of tooth beads 200 and a series of spacing beads 202, each preferably equally spaced from each other circumferentially and staggered vertically thereby to function as clutch ring 24 functions. In addition to functioning satisfactorily, the segmental clutch ring also conserves plastic and facilitates the molding operation.

Further, to facilitate molding and assembly of the closure from the premolded assembly 112, preferably the connecting web may comprise a plurality of frangible segments 160A, preferably spaced apart by a series of slots 160B. The slots 160B ease the breaking of the frangible segments 160A as the assembly 12 is severed as in the manner described in connection with the embodiment of FIG. 1 into the assembled closure of the type shown in FIG. 7. It is to be understood that the collar portion 114 may be substantially identical to that of collar portion 14 and that the teeth on tooth beads 200 may be spaced and proportioned just like teeth 28.

Except as otherwise noted the embodiment of FIGS. 8 and 9 may be identical to that of FIGS. 1–7, inclusive.

Child resistant closure assemblies of, and made in accordance with, this invention are highly advantageous for a number of reasons, including those already stated. Additionally, unlike most other child-resistant two piece closure assemblies, child resistant closures of this invention may provide one full turn of thread engagement, without requiring a special neck height to provide sufficient clearance for downward engagement of the clutch components. Further, the collar spins freely to a much greater extent than with most other two-piece assemblies. There is minimal drag resisting free rotation of the collar in the "safe" position, yet the parts may be close fitting to provide stability. Also, the amount of vertical movement required is substantially less than required by most two piece closures. Finally, the closures may be vertically loaded in storage without adversely affecting the safety characteristic of the closure, unlike those closures which utilize a plastic spring for maintaining an overcap in an up-position vis-a-vis the closure.

From the foregoing, it will become apparent to those skilled in the art that modifications may be effected without departing from the spirit and scope of the invention. It is to be understood that no limitation with respect to the specific embodiment illustrated herein is intended or should be inferred. It is, of course, intended to cover by the appended claims all such modifications as fall within the scope of the claims.

What is claimed is:

1. A child resistant closure assembly for the threaded neck of a container comprising:

an internally threaded closure defining an internal thread complementary to the thread of a container neck and an internal upper sealing surface, said closure defining a sidewall providing a radially outwardly extending clutch ring, said clutch ring defining a multiplicity of upwardly facing closure teeth spaced about the periphery of the clutch ring, each said tooth providing a generally vertical leading edge and a substantially inclined trailing edge, an open-topped collar comprising an outer gripping surface and defining an inner recess receiving said clutch ring, and means for defining said recess comprising a lower inwardly projecting retention bead and an upper collar clutch portion, the lower surface of said clutch portion comprising a multiplicity of downwardly facing collar teeth, each said collar tooth defining a generally vertical leading edge and a substantially angled trailing edge, and said collar being movable vertically upwardly with respect to said closure by no more than about twice the distance between the confronting surfaces of said clutch ring and said retention bead, whereby when said collar is rotated in a clockwise direction said generally vertical leading edges engage, and when said collar is rotated in a counterclockwise direction said trailing edges engage and said angled collar trailing edge rides up said inclined trailing edge except when a downward force is exerted against said collar to maintain said trailing edges in engagement.

2. A child resistant closure assembly in accordance with claim 1 wherein said collar and said closure are of about the same height and wherein said clutch ring is positioned generally intermediate of the height of said sidewall.

3. A child resistant closure assembly in accordance with claim 2 wherein said closure teeth and said collar teeth are equal in number.

4. A child resistant closure assembly in accordance with claim 2 wherein said inclined and angled tooth edges are at different angles to the vertical.

5. A child resistant closure assembly in accordance with claim 3 wherein said inclined and angled tooth edges as inclined at different angles to the vertical.

6. A child resistant closure assembly in accordance with claim 1 wherein said clutch ring is segmental.

7. A child resistant closure assembly in accordance with claim 6 wherein said clutch ring comprises segmental tooth beads.

8. A child resistant closure assembly in accordance with claim 7 wherein said clutch ring comprises segmental spacing beads vertically spaced from said tooth beads.

9. A molded unitary assembly adapted to be formed into a child resistant closure assembly for the threaded neck of a container comprising:

an internally threaded closure portion defining an internal thread and an internal upper sealing surface, said closure portion defining a sidewall providing a radially outwardly extending clutch ring, said clutch ring defining a multiplicity of upwardly facing closure teeth spaced about the periphery of the clutch ring, each said tooth providing a generally vertical leading edge and a substantially inclined trailing edge, an open-topped collar portion, said collar portion comprising an outer gripping surface and an inner recess for receiving said clutch ring, and means defining said recess comprising a lower inwardly projecting retention bead and an upper collar clutch portion each of a diameter less than a diameter of said clutch ring, the lower surface of said clutch portion comprising a multiplicity of downwardly facing collar teeth, each said collar tooth defining a generally vertical leading edge and a substantially angled trailing edge, a frangible web means connecting said collar portion and said closure portion with said clutch ring spaced vertically away from and out of said recess, whereby when said closure and collar are forced towards each other, said frangible web is adapted to be broken and said clutch ring is adapted to be forced past a collar portion of lesser diameter then that of said clutch ring into said recess.

10. A molded unitary assembly in accordance with claim 9 wherein said collar and said closure as of about the same height and wherein said clutch rings is positioned generally intermediate the height of said sidewall.

11. A molded unitary assembly in accordance with claim 9 wherein said closure teeth and said collar teeth as equal in number.

12. A molded unitary assembly in accordance with claim 10 wherein said inclined and angled tooth edges are at different angles to the vertical.

13. A molded unitary assembly in accordance with claim 9 wherein said clutch ring comprises segmental tooth bead portions.

14. A molded unitary assembly in accordance with claim 9 wherein said frangible web means comprises frangible segments spaced apart by slot segments.

* * * * *